US011095076B2

(12) United States Patent
Ruffini et al.

(10) Patent No.: US 11,095,076 B2
(45) Date of Patent: Aug. 17, 2021

(54) CABLE CONNECTOR

(71) Applicant: TE Connectivity Services GmbH, Schaffhausen (CH)

(72) Inventors: Nicholas Paul Ruffini, Lancaster, PA (US); Kevin Michael Thackston, York, PA (US); Graham Harry Smith, Jr., Mechanicsburg, PA (US); Scott Eric Walton, Mount Joy, PA (US); Thomas Gregory Gartlan, Annville, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/713,612

(22) Filed: Dec. 13, 2019

(65) Prior Publication Data

US 2021/0184405 A1 Jun. 17, 2021

(51) Int. Cl.

| | |
|---|---|
| ***H01R 13/6589*** | (2011.01) |
| ***H01R 13/502*** | (2006.01) |
| ***H01R 13/04*** | (2006.01) |
| ***H01R 43/048*** | (2006.01) |
| ***H01R 43/24*** | (2006.01) |

(Continued)

(52) U.S. Cl.

CPC ..... *H01R 13/6589* (2013.01); *H01R 13/04* (2013.01); *H01R 13/502* (2013.01); *H01R 43/048* (2013.01); *H01R 43/24* (2013.01); *H01R 4/184* (2013.01); *H01R 2107/00* (2013.01)

(58) Field of Classification Search

CPC ..... H01R 43/048; H01R 43/24; H01R 4/184; H01R 24/86; H01R 2107/00; H01R 13/04; H01R 13/6585; H01R 13/502; H01R 13/41; H01R 13/424; H01R 13/4367; H01R 13/6592; H01R 13/65912;

(Continued)

(56) References Cited

U.S. PATENT DOCUMENTS 5,768,771 A * 6/1998 O'Sullivan ..... H01R 9/0518 29/828
6,764,350 B2 * 7/2004 Kosmala ..... H01R 13/65912 439/752

(Continued)

FOREIGN PATENT DOCUMENTS

JP H09147929 A 6/1997

OTHER PUBLICATIONS

International Search Report, International Application No. PCT/IB2020/061649, International Filing Date Dec. 8, 2020.

*Primary Examiner* — Oscar C Jimenez

(57) ABSTRACT

A cable connector includes a cable having wire pairs and contacts in contact pairs. The contacts of the contact pairs may be simultaneously crimped to the corresponding wires by a crimp tool. Pair holders hold the contact pairs with an overmolded body molded around supporting bases of the contacts of the contact pair to fix relative positions of the contacts. The cable connector includes a pair shield having shield elements forming shield pockets receiving wire pairs, contact pairs, and pair holders. The cable connector includes a retainer having a retainer cavity that receives the wire pairs and the pair shield. The retainer includes a contact support to support the pair holders and the contact pairs. The cable connector includes an outer shell having an outer shell cavity that receives the retainer and provides electrical shielding for the contact pairs.

20 Claims, 5 Drawing Sheets

(51) Int. Cl.
*H01R 4/18* (2006.01)
*H01R 107/00* (2006.01)

(58) Field of Classification Search
CPC ..... H01R 13/65915; H01R 13/65917; H01R 13/426; H01R 13/6589
See application file for complete search history.

(56) References Cited

U.S. PATENT DOCUMENTS

| | | | | |
|---|---|---|---|---|
| 7,044,789 | B2 * | 5/2006 | Yohn | H01R 9/037 439/599 |
| 7,494,377 | B2 * | 2/2009 | Yohn | H01R 9/03 439/460 |
| 7,727,021 | B2 * | 6/2010 | Haruna | H01R 9/037 439/607.5 |
| 8,894,448 | B2 * | 11/2014 | Affeltranger | H01R 13/6592 439/701 |
| 9,502,796 | B2 * | 11/2016 | Genau | H01R 12/724 |
| 9,627,819 | B2 * | 4/2017 | Post | H01R 13/6599 |
| 2003/0150106 | A1 * | 8/2003 | Ikeda | H01R 43/01 29/761 |
| 2004/0038591 | A1 | 2/2004 | Clement et al. | |
| 2012/0034809 | A1 | 2/2012 | Reimchen | |
| 2013/0137310 | A1 | 5/2013 | Genau | |
| 2013/0237100 | A1 | 9/2013 | Affeltranger | |
| 2014/0302724 | A1 * | 10/2014 | Ono | H01R 13/4364 439/751 |
| 2015/0295365 | A1 | 10/2015 | Post et al. | |
| 2018/0097309 | A1 * | 4/2018 | Haspel | H01R 9/032 |
| 2020/0259287 | A1 * | 8/2020 | Tristani | H01R 13/631 |

* cited by examiner

CABLE CONNECTOR

BACKGROUND OF THE INVENTION

The subject matter herein relates generally to cable connectors.

Cable connectors are used in many applications, such as in military and aeronautical applications. For example, the cable connectors may include differential pair contacts terminated to ends of twisted wire pairs. Some known cable connectors are known as quadrax connectors having four differential pairs of contacts arranged in different quadrants of the cable connector. The cable connector includes an outer shell providing shielding for the contact pairs. However, known cable connectors are not without disadvantages. For instance, assembly of the cable connector is time consuming. For example, each of the contacts is separately crimped to the corresponding wire. Additionally, each of the wires and contacts are individually loaded into a retainer that holds the relative positions of the contacts within the outer shell of the cable connector. The crimping and assembly is time consuming.

A need remains for a cable connector that may be manufactured and assembled in a cost effective and reliable manner.

BRIEF DESCRIPTION OF THE INVENTION

In one embodiment, a cable connector is provided including a cable having wires arranged in wire pairs, contacts arranged in contact pairs each including a supporting base between a mating end and a terminating end terminated to the corresponding wire, and pair holders holding the corresponding contact pairs. Each pair holder has an overmolded body molded around the supporting bases of the contacts of the corresponding contact pair. The overmolded body is manufactured from a dielectric material. The pair holder fixes relative positions of the contacts within the corresponding contact pair. The terminating ends extend rearward from the overmolded body for termination to the wires. The cable connector includes a pair shield having shield elements forming shield pockets receiving corresponding wire pairs, contact pairs, and pair holders. The shield elements provide shielding between the contact pairs. The cable connector includes a retainer extending between a front and a rear. The retainer has a retainer cavity open at the rear to receive the wire pairs and the pair shield. The retainer includes a contact support at the front to support the pair holders and the contact pairs. The cable connector includes an outer shell extending between a front and a rear. The outer shell has an outer shell cavity open at the rear to receive the retainer. The outer shell is conductive and provides electrical shielding for the contact pairs.

In another embodiment, a cable connector is provided including a cable having wires arranged in wire pairs, contacts arranged in contact pairs each including a supporting base between a mating end and a terminating end having a crimp barrel crimped to the corresponding wire. The cable connector includes pair holders holding the corresponding contact pairs. Each pair holder has an overmolded body molded around the supporting bases of both contacts of the corresponding contact pair. The overmolded body is manufactured from a dielectric material. The pair holder fixes relative positions of the contacts within the corresponding contact pair. The terminating ends extend rearward from the overmolded body for termination to the wires. The mating ends extend forward of the overmolded body for mating with mating contacts of a mating connector. Each overmolded body includes a locating surface configured to engage a retainer for locating each of the pair holders relative to each other within the retainer.

In another embodiment, a method of manufacturing a cable connector is provided including overmolding pair holders around supporting bases of contact pairs of contacts such that mating ends of the contacts extend forward of the pair holders and terminating ends of the contacts having crimp barrels extend rearward of the pair holders. The pair holders fix relative positions of the contacts of the corresponding contact pairs. Each overmolded pair holder and contact pair define a contact assembly. The method includes simultaneously crimping the crimp barrels of both contacts of the corresponding contact assembly to wires of corresponding wire pairs to form a pair assembly. The method includes loading a pair shield into a retainer between the wire pairs to provide electrical shielding between the pair assemblies. The method includes loading each pair assembly into the retainer such that the pair holders engage the retainer to position each of the contact assemblies relative to each other. The method includes loading the retainer, pair shield, and pair assemblies into a cavity of an outer shell to provide electrical shielding around the pair assemblies.

DETAILED DESCRIPTION OF THE INVENTION

Figure 1:
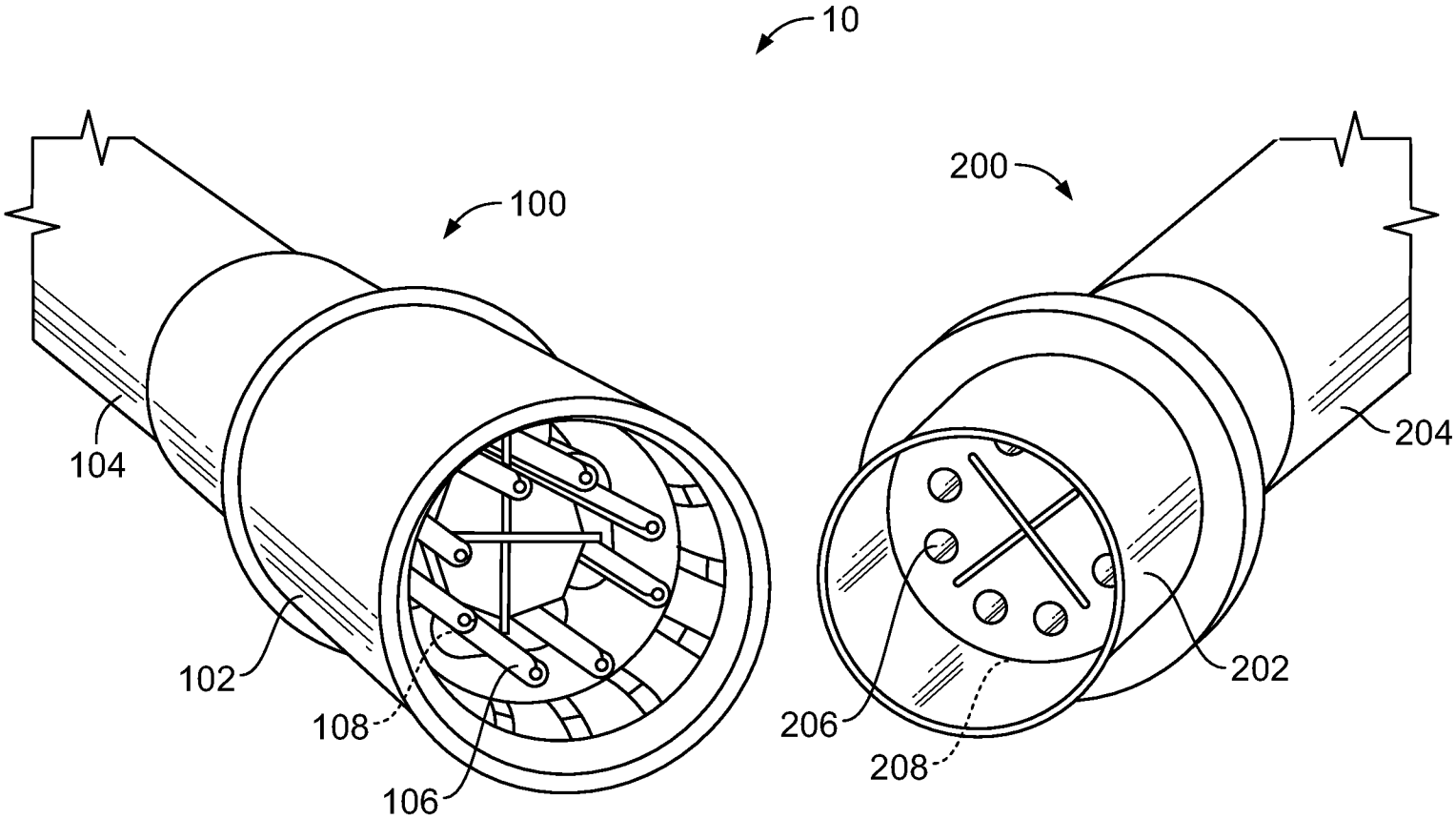
FIG. 1 illustrates a communication system in accordance with an exemplary embodiment showing cable connectors.

FIG. 1 illustrates a communication system 10 in accordance with an exemplary embodiment showing a first cable connector 100 configured to be mated with a second cable connector 200. The first cable connector 100 includes a connector 102 provided at an end of a cable 104. The connector 102 includes a plurality of contacts 106 arranged in contact pairs 108. The second cable connector 200 includes a connector 202 provided at an end of a cable 204. The connector 202 includes a plurality of contacts 206 arranged in contact pairs 208. The contacts 206 are configured to be mated with corresponding contacts 106. In the illustrated embodiment, the contacts 206 are socket contacts and the contacts 106 are pin contacts; however, other types of contacts may be used in alternative embodiments.

In an exemplary embodiment, the connectors 102, 202 are quadrax connectors each including four contact pairs 108, 208, respectively. The contact pairs 108, 208 are arranged in quadrants. Other types of connectors may be used in alternative embodiments having greater or fewer contact pairs 108, 208. The description below references the first cable connector 100 and the components of the cable connector 100; however, the second cable connector 200 may include similar components and be manufactured in a similar manner as described below with reference to the first cable connector 100.

Figure 2:
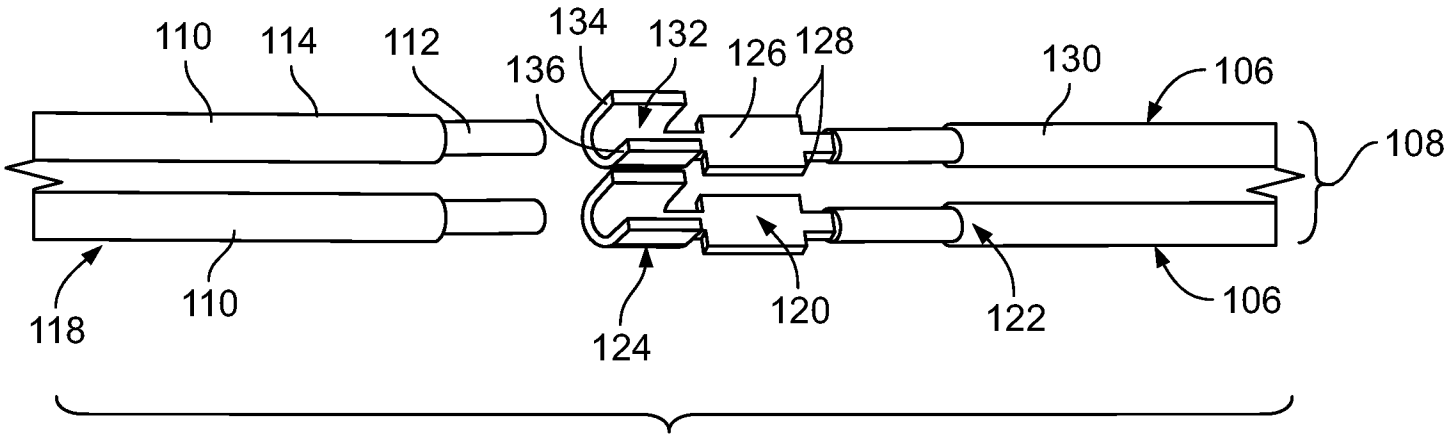
FIG. 2 illustrates a contact pair for the cable connector in accordance with an exemplary embodiment.

FIG. 2 illustrates one of the contact pairs 108 of contacts 106 in accordance with an exemplary embodiment showing wires 110 of the cable 104 (shown in FIG. 1) relative to the contacts 106. Each wire 110 includes a conductor 112 and an insulator 114 around the conductor 112. In various embodiments, the wire may be shielded having a wire shield around the insulator 114. In an exemplary embodiment, the wires 110 are twisted running the length of the cable 104 and untwisted at the end for termination to the contacts 106.

Each contact 106 includes a supporting base 120 between a mating end 122 and a terminating end 124. In an exemplary embodiment, the contact 106 is a stamped and formed contact. The supporting base 120 is generally flat including a pad 126 and wings 128 extending from the pad 126. In various embodiments, the pad 126 may have a slight curvature, such as for transitioning to the mating end 122 and/or the terminating end 124.

In an exemplary embodiment, the mating end 122 is cylindrical. For example, the mating end 122 may be formed by rolling the mating end 122 of the contact 106 into a tubular shape. In the illustrated embodiment, the mating end 122 includes a pin 130; however, other types of mating ends may be provided in alternative embodiments, such as a socket. In other various embodiments, the mating end 122 may have other shapes other than a cylindrical shape, such as a blade contact, a split beam contact, and the like.

In an exemplary embodiment, the terminating end 124 has a curved shape. For example, in the illustrated embodiment, the terminating end 124 includes a crimp barrel 132 configured to be crimped to the conductor 112 and/or the insulator 114 of the wire 110. The crimp barrel 132 includes opposing crimp arms 134, 136 may be folded over and crimped to the wire 110. In various embodiments, the crimp arms 134, 136 may form an F-crimp.

In an exemplary embodiment, the wings 128 extend outward beyond the pin 130 and beyond the crimp barrel 132. The wings 128 provided large surface area for the supporting base 120. In an exemplary embodiment, the pads 126 and the wings 128 of the supporting bases 120 of the contact pair 108 are coplanar with each other. As such, the pins 130 of the contact pair 108 may be aligned with each other and the crimp barrels 132 of the contact pair 108 may be aligned with each other. In an exemplary embodiment, the supporting bases 120 of the contact pair 108 are configured to be overmolded by a dielectric body to hold the relative positions of both contacts 106 of the contact pair 108.

Figure 3:
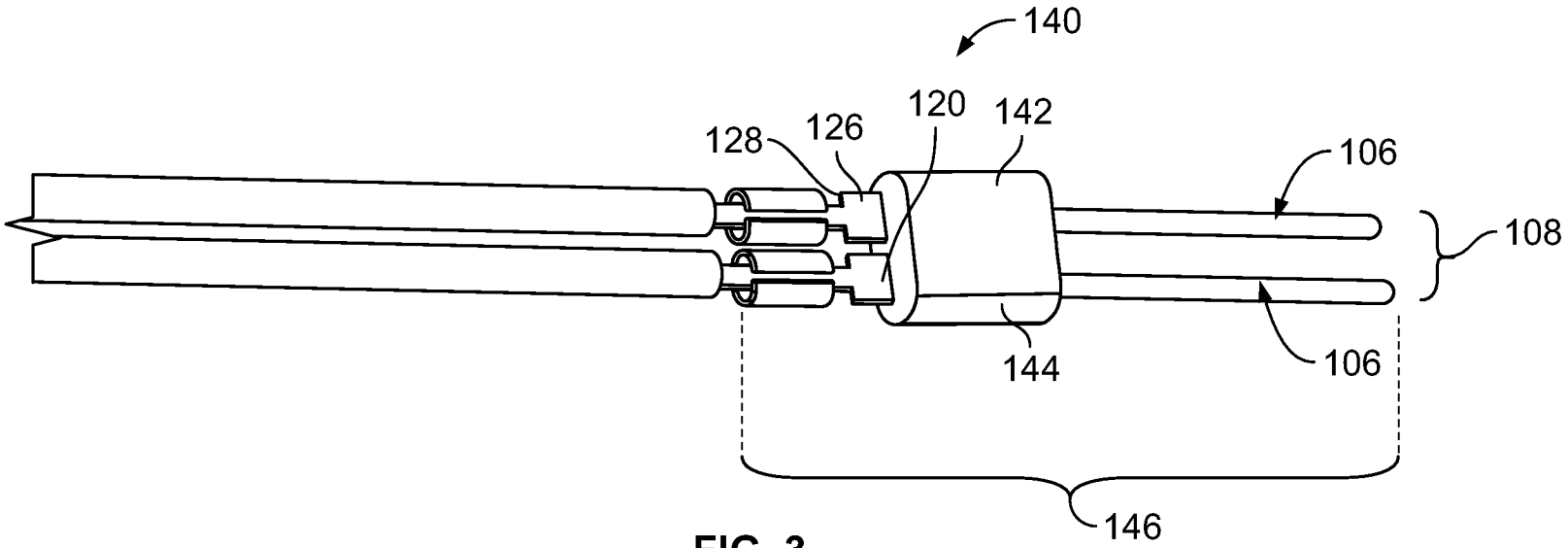
FIG. 3 illustrates a pair assembly of the cable connector in accordance with an exemplary embodiment.

FIG. 3 illustrates a pair assembly 140 of the cable connector 100 (shown in FIG. 1). The pair assembly 140 includes the contact pair 108 of contacts 106, a wire pair 118 of the wires 110, and a pair holder 142 used to hold the contact pair 108. During assembly, the contact 106 of the contact pair 108 are overmolded by an overmold body 144 that forms a pair holder 142. The overmold body 144 is manufactured from a dielectric material, such as a plastic material. The overmold body 144 is formed around the supporting bases 120 of the contacts 106. For example, the overmold body 144 is formed in place on the supporting bases 120 to hold the contacts 106 together as a unit. The pair holder 142 holds the relative positions of the contacts 106. The pair holder 142 and the contact pair 108 of contacts 106 together define a contact assembly 146. The contact assembly 146 and the wire pair 118 of wires 110 together define the pair assembly 140.

In an exemplary embodiment, the overmold body 144 completely encases the supporting base 120, such as the pad 126 and the wings 128. The overmold body 144 is formed above, below and along the sides of both of the supporting bases 120. The overmold body 144 fills the space between the supporting bases 120 of the contact pair 108. In an exemplary embodiment, the mating ends 122 extend forward of the pair holder 142 and the terminating ends 124 extend rearward of the pair holder 142. As such, the pins 130 are exposed forward of the pair holder 142 for mating with the contacts 206 of the cable connector 200 (both shown in FIG. 1) and the crimp barrels 132 are exposed rearward of the pair holder 142 for crimping to the wires 110. In an exemplary embodiment, both contacts 106 are fixed in position relative to each other by the pair holder 142 for simultaneously crimping the crimp barrels 132 to the wires 110, thus reducing the overall crimping time (for example, reduces the crimping time by half).

Figure 4:
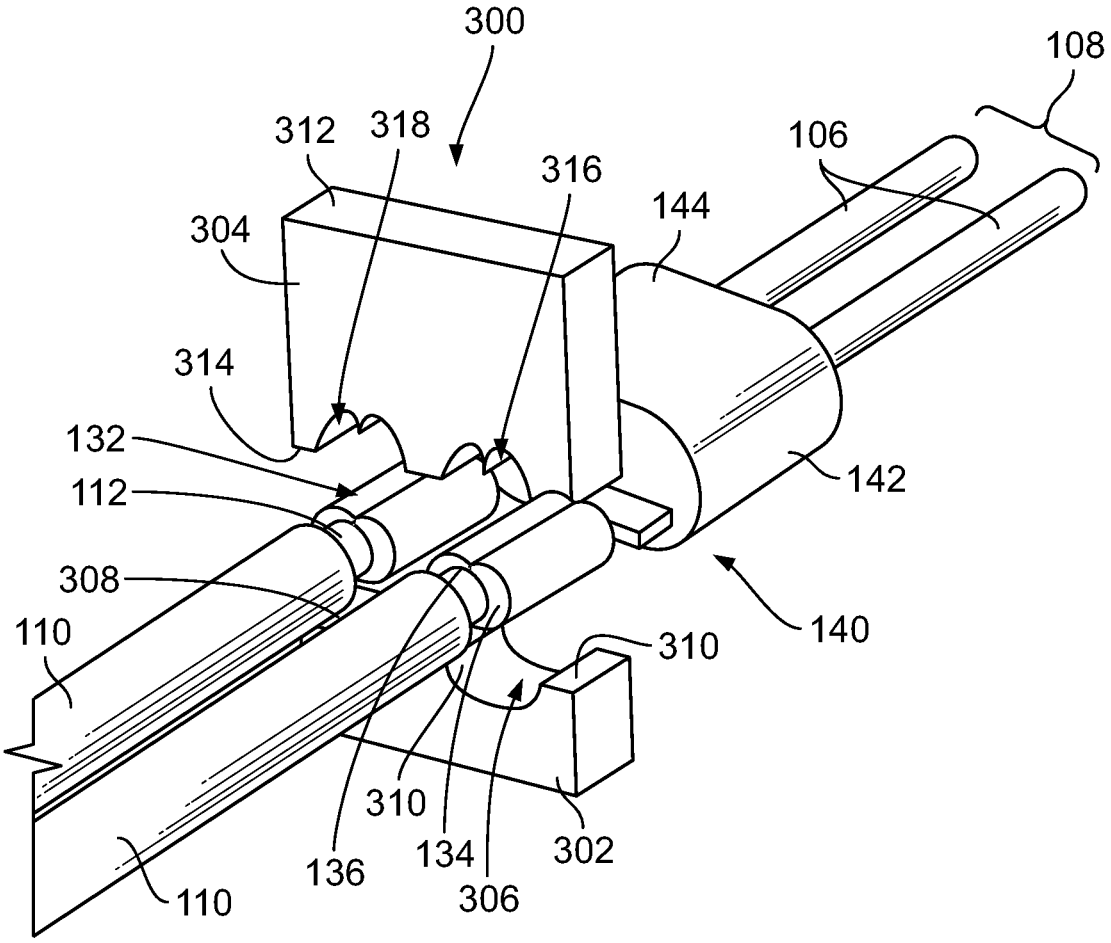
FIG. 4 is a perspective view of the pair assembly relative to a crimp tool used to crimp the contacts to wires in accordance with an exemplary embodiment.

FIG. 4 is a perspective view of the pair assembly 140 relative to a crimp tool 300 used to crimp the contacts 106 to the wires 110. The crimp tool 300 includes an anvil 302 and a crimper 304. The crimper 304 and/or the anvil 302 are driven toward each other during a crimp stroke to crimp the contacts 106 to the wires 110. For example, the anvil 302 and the crimper 304 may be coupled to handles of a hand tool used to press the anvil 302 and the crimper 304 together during the crimping process. In other various embodiments, a crimping machine, such as a press may be used to actuate the crimper 304 and/or the anvil 302. The crimper 304 forms the crimp arms 134, 136 of the crimp barrels 132 around the conductors 112 of the wires 110. In an exemplary embodiment, the crimp tool 300 is a dual crimper used to crimp both of the contacts 106 within the pair to the corresponding wires 110, simultaneously. For example, the same crimp stroke is used to crimp both of the crimp barrels 132 around the conductors 112 of the wires 110.

The anvil 302 includes a first seat 306 and a second seat 308. The first and second seats 306, 308 may be provided at a top of the anvil 302. The first seat 306 receives and supports a first contact **106*a* during the crimping process and the second seat 308 receives and supports a second contact 106*b* during the crimping process. The first and second seats 306, 308 may be contoured to form the crimp barrels 132 around the conductors 112 of the wires 110 during the crimping process. In an exemplary embodiment, the anvil 302 includes locating walls 310 used to locate the crimp barrels 132 of the contacts 106 relative to the first and second seats 306, 308. Optionally, one of the locating walls 310 may be located between the first and second seats 306, 308**.

The crimper 304 includes a body 312 having a crimping end 314 that faces the anvil 302. The crimping end 314 may be provided at the bottom of the crimper 304. The crimper 304 includes a first crimping pocket 316 at the crimping end 314 and a second crimping pocket 318 at the crimping end 314. The first crimping pocket 316 receives the first contact **106*a* and has a crimping profile used to form the crimp barrel 132 around the conductor 112 of the wire 110. The second crimping pocket 318 receives the second contact 106*b* and has a crimping profile used to form the crimp barrel 132 around the conductor 112 of the wire 110**.

The overmold body 144 forming the pair holder 142 holds the relative positions of the contacts 106 of the contact pair 108. For example, the overmold body 144 fixes the crimp barrels 132 relative to each other for positioning the contact 106 in the crimp tool 300. The overmold body 144 aligns the crimp barrels 132 relative to the seat 306, 308 and the anvil 302 and the crimping pocket 316, 318 in the crimper 304. As such, both crimp barrels 132 of the contact 106 may be simultaneously crimped by the crimp tool 300. The pair holder 142 eliminates the process of individually crimping each contact 106 to the respective wire 110, reducing manufacture time.

Figure 5:
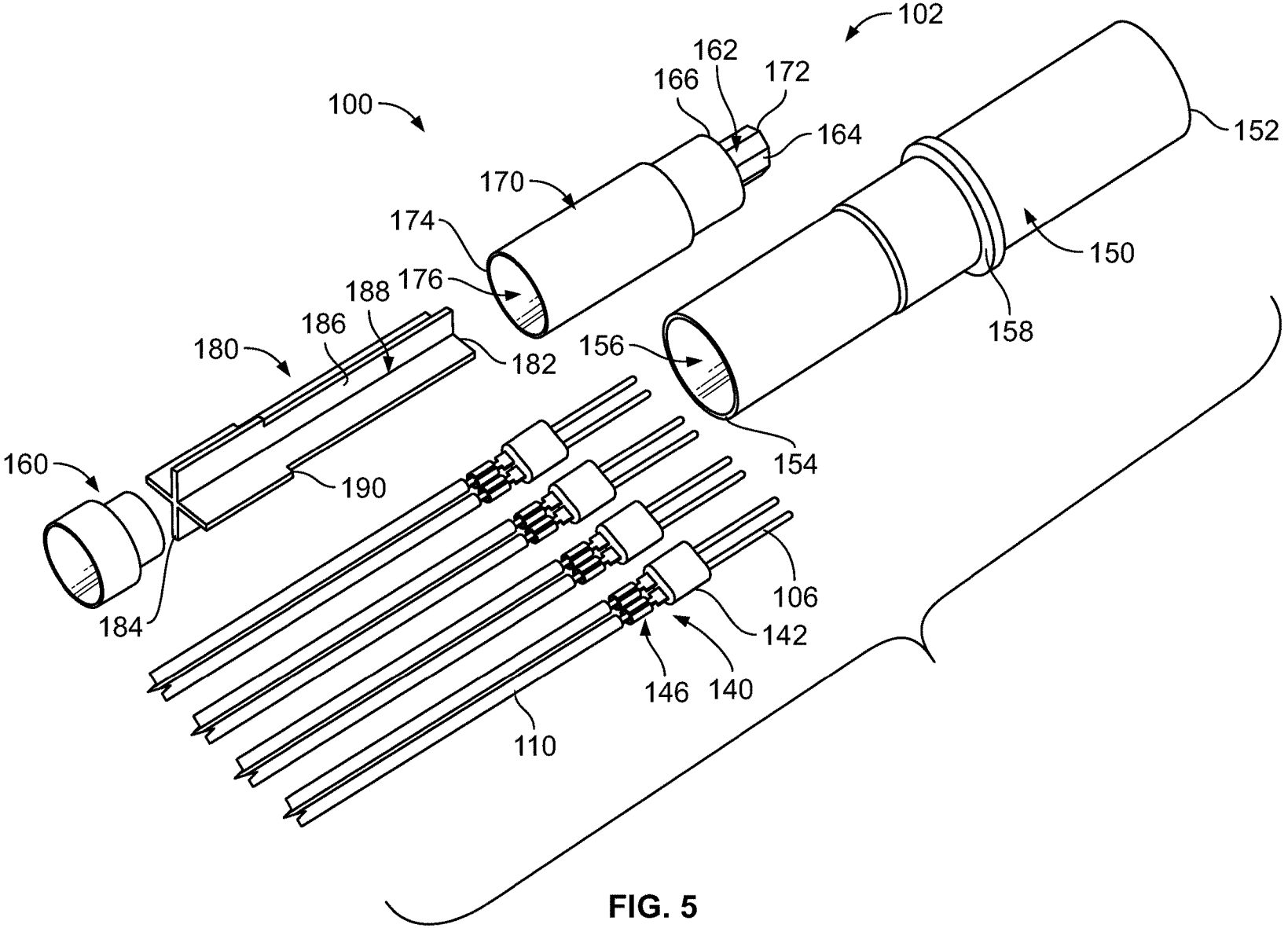
FIG. 5 is an exploded view of the cable connector in accordance with an exemplary embodiment.

FIG. 5 is an exploded view of the cable connector 100 in accordance with an exemplary embodiment. In an exemplary embodiment, the cable connector 100 includes four pair assemblies 140 defining a quadrax cable connector; however, the cable connector 100 may include greater or fewer pair assemblies 140 in alternative embodiments. The cable connector 100 further includes an outer shell 150, a ferrule 160, a retainer 170, and a pair shield 180. The outer shell 150 receives the pair assemblies 140, the ferrule 160, the retainer 170, and the pair shield 180.

In an exemplary embodiment, the outer shell 150 extend between a front 152 and a rear 154. The outer shell 150 includes an outer shell cavity 156 between the front 152 and the rear 154. In an exemplary embodiment, the outer shell 150 is generally cylindrical. The outer shell 150 may be manufactured from a conductive material to provide electrical shielding for the contacts 106 of the pair assemblies 140. Optionally, the outer shell 150 may be screw machined; however, the outer shell 150 may be manufactured by other processes in alternative embodiments, such as being diecast or a stamped and formed part. In an exemplary embodiment, the outer shell 150 includes a flange 158 around the outer shell 150, such as approximately centered between the front 152 and the rear 154. The outer shell 150 receives the ferrule 160, the retainer 170, and the pair shield 180 in the outer shell cavity 156 through the rear 154. The outer shell 150 is coupled to the cable connector 200 at the front 152. Optionally, the outer shell cavity 156 may receive a portion of the cable connector 200 through the front 152. For example, the front portion of the outer shell cavity 156 may define a mating cavity configured to receive the mating end of the cable connector 200.

The ferrule 160 is configured to be coupled to the cable 104 (shown in FIG. 1). For example, an end of a cable shield of the cable 104 may be folded around the front of the ferrule 160 to provide a mechanical and electrical connection between the cable 104 and the connector 102. In various embodiments, the rear 154 of the outer shell 150 may be crimped to the ferrule 160 to create an electrical connection between the cable shield and the outer shell 150.

The retainer 170 extends between a front 172 and a rear 174. The retainer 170 includes a retainer cavity 176 that receives the pair shield 180 and the wires 110. For example, the retainer cavity 176 may be open at the rear 174 to receive the wires 110 and the pair shield 180. In an exemplary embodiment, the wires 110 are fed through the cavity 156 prior to crimping the contact assemblies 146 to the wires 110. In various embodiments, the retainer cavity 176 is hollow or open to receive the pair shield 180 and the wires 110. Alternatively, the retainer cavity 176 may have a corresponding shape as the pair shield 180 and the wires 110. For example, the retainer cavity 176 may include individual wire channels that receive the wires 110 and a shield cavity that receives the pair shield 180.

In an exemplary embodiment, the retainer 170 includes a contact support 162 at the front 172. The contact support 162 includes platforms 164 for receiving and supporting corresponding pair holders 142. For example, the platforms 164 may have complementary shapes as the pair holders 142 to receive and support the pair holders 142. Optionally, the platforms 164 may be separated from each other by separating walls, which are used to position and separate the pair holders 142 relative to each other. In an exemplary embodiment, the retainer 170 includes locating walls 166 for locating the pair holders 142 relative to the retainer 170. In the illustrated embodiment, the locating walls 166 are forward facing end configured to engage and locate the rear edges of the pair holders 142. Other locating walls 166 may be provided in alternative embodiments.

The pair shield 180 extends between a front 182 and a rear 184. The pair shield 180 includes shield elements 186 that define shield pockets 188. Each shield pocket 188 is configured to receive corresponding pair assembly 140. In an exemplary embodiment, the shield elements 186 form quadrants with each quadrant having a corresponding shield pocket 188. For example, the pair shield 180 may be cross shaped. The shield elements 186 may have other shapes in alternative embodiments. In an exemplary embodiment, the pair holders 142 are configured to engage the shield elements 186 to locate the contacts 106 relative to the pair shield 180. For example, each pair holder 142 may engage two of the shield elements 186 to position the contacts 106 in the corresponding shield pockets 188. In an exemplary embodiment, the pair shield 180 includes locating fins 190 extending from the shield elements 186. The locating fins 190 are used to locate the pair shield 180 relative to the retainer 170. For example, the locating fins 190 may be received in the retainer cavity 176 and engage a surface or shoulder within the retainer 170 to axially and/or rotationally position the pair shield 180 relative to the retainer 170.

Figure 6:
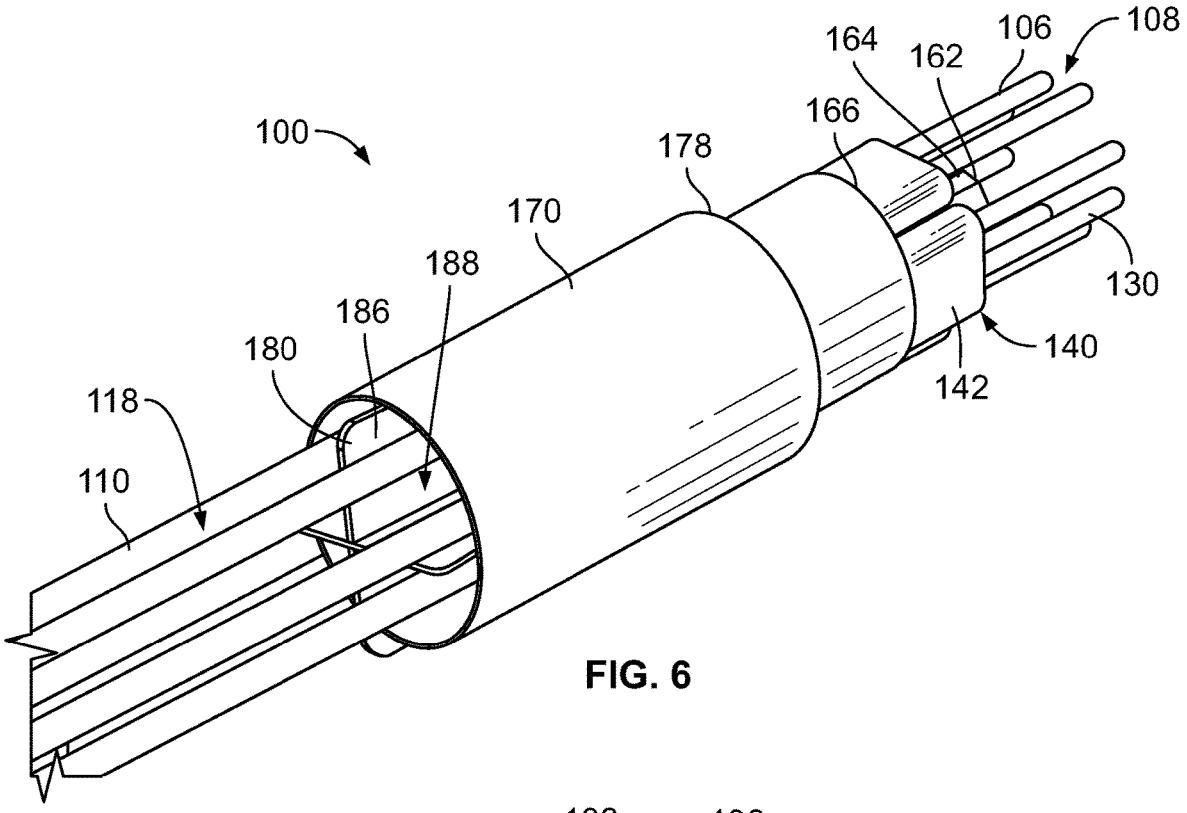
FIG. 6 is a partially assembled view of the cable connector in accordance with an exemplary embodiment.

FIG. 6 is a partially assembled view of the cable connector 100 in accordance with an exemplary embodiment. FIG. 6 illustrates the pair assemblies 140 coupled to the retainer 170. FIG. 6 illustrates the pair shield 180 coupled to the retainer 170. The pair shield 180 provides electrical shielding for each of the pair assemblies 140. For example, the shield elements 186 provide electrical shielding between each of the pair assemblies 140. The pair holders 142 are received in corresponding shield pocket 188. The wires 110 are received in corresponding shield pockets 188 to provide electrical shielding between the wire pairs 118.

When assembled, the pair holders 142 are coupled to the contact support 162 of the retainer 170. Each pair holder 142 holds both contacts 106 of the corresponding contact pair 108 together as a unit such that both contacts 106 may be loaded into and coupled to the retainer 170 simultaneously. The pair holder 142 eliminates the process of individually loading each contact into the retainer 170, reducing assembly time (for example, reduces the loading time by half). The platforms 164 support corresponding pair holders 142. For example, the platforms 164 hold radial positions of the pair holders 142 relative to the retainer 170. In an exemplary embodiment, the pair holders 142 engage the locating walls 166 to locate the pair holders 142 relative to the retainer 170. For example, the locating walls 166 are located immediately behind the pair holders 142 and are used to axially position the pair assemblies 140 relative to the retainer 170. The locating walls 166 block rearward movement of the pair assemblies 140 relative to the retainer 170. The pins 130 of the contact 106 extend forward of the pair holders 142 and forward of the retainer 170 for mating with the second cable connector 200 (shown in FIG. 1).

The assembly, including the retainer 170, the pair shield 180, and the pair assemblies 140 are configured to be loaded into the outer shell cavity 156 (shown in FIG. 5). In an exemplary embodiment, the retainer 170 includes a locating shoulder 178 for locating the retainer 170 within the outer shell 150. In the illustrated embodiment, the locating shoulder 178 extend circumferentially around the retainer 170. Other types of locating features may be used in alternative embodiments.

Figure 7:
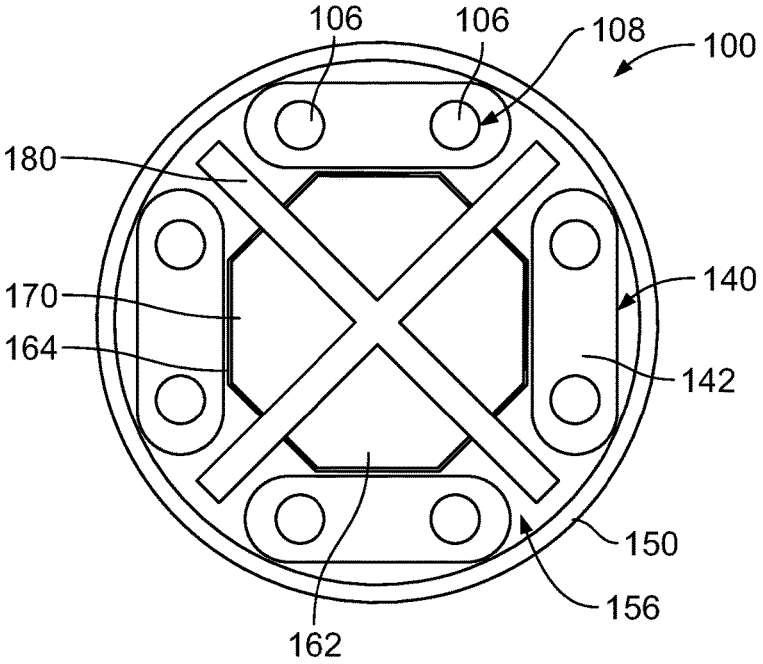
FIG. 7 is a cross-sectional view of the cable connector in accordance with an exemplary embodiment.

FIG. 7 is a cross-sectional view of the cable connector 100 in accordance with an exemplary embodiment. FIG. 7 illustrates the pair assemblies 140 relative to the retainer 170 and the outer shell 150. The pair holder 142 is used to position the corresponding contact pair 108 relative to the retainer 170 and the outer shell 150. When assembled, the pair holders 142 are supported by the platforms 164 of the contact support 162. In an exemplary embodiment, outer surfaces of the pair holders 142 engage the inner surface of the outer shell 150. The outer shell 150 is used to position the pair holders 142 within the outer shell cavity 156. The contacts 106 of each contact pair 108 have fixed positions and spacing relative to each other (maintained by the pair holders 142), which corresponds to the spacing of the contact 206 of the contact pairs 208 of the second cable connector 200 (shown in FIG. 1). Optionally, the pair holders 142 may have some amount of floating movement (for example, a small gap) between the outer shell 150 and the platforms 164 of the contact support 162 to adjust alignment of the contact pair 108 with the contact pair 208 of the second cable connector 200 during mating. The pair shield 180 provides electrical shielding between the contact pairs 108. The outer shell 150 provides electrical shielding around the contact pairs 108.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable connector comprising:

a cable having wires arranged in wire pairs;

contacts arranged in contact pairs, each contact including a supporting base between a mating end and a terminating end, the terminating end being terminated to the corresponding wire;

pair holders holding the corresponding contact pairs, each pair holder having an overmolded body molded around both of the supporting bases of the contacts of the corresponding contact pair, the overmolded body being manufactured from a dielectric material, the pair holder fixing relative positions of both of the contacts within the corresponding contact pair, the terminating ends extending rearward from the overmolded body for termination to the wires;

a pair shield having shield elements forming shield pockets, the shield pockets receiving corresponding wire pairs, contact pairs, and pair holders, the shield elements providing shielding between the contact pairs;

a retainer extending between a front and a rear, the retainer having a retainer cavity open at the rear to receive the wire pairs and the pair shield, the retainer including a contact support at the front to support the pair holders and the contact pairs; and an outer shell extending between a front and a rear, the outer shell having an outer shell cavity open at the rear to receive the retainer, the outer shell being conductive and providing electrical shielding for the contact pairs.

2. The cable connector of claim 1, wherein both contacts of the contact pair are simultaneously loaded into the retainer with the pair holder.

3. The cable connector of claim 1, wherein the overmolded body includes an outer surface engaging the contact support of the retainer to locate the contacts relative to the retainer.

4. The cable connector of claim 1, wherein the overmolded body extends between a front and a rear, the mating ends of the contacts extending forward of the front of the overmolded body, at least one of the front or the rear of the overmolded body engaging a locating wall of the retainer to axially position the pair holder relative to the retainer.

5. The cable connector of claim 1, wherein the overmolded body holds relative positions of the terminating ends of the contacts for termination of the terminating ends to the wires.

6. The cable connector of claim 1, wherein the terminating ends of both contacts of the contact pair are simultaneously terminated to the wires of the corresponding wire pair.

7. The cable connector of claim 1, wherein the terminating ends of the contacts include crimp barrels rearward of the pair holder, the overmolded body holding the crimp barrels relative to each other for simultaneous crimping of the crimp barrels to the corresponding wires.

8. The cable connector of claim 1, wherein the supporting bases of the contacts include generally flat pads, the overmolded body holding the supporting bases generally coplanar.

9. The cable connector of claim 1, wherein the contacts are stamped and formed contacts having generally flat supporting bases, generally cylindrical mating ends extending forward from the supporting bases, and generally cylindrical terminating ends extending rearward from the supporting bases.

10. The cable connector of claim 1, wherein the shield pockets are arranged in quadrants, the cable connector comprising four wire pairs, four contact pairs, and four pair holders received in corresponding quadrants of the pair shield.

11. The cable connector of claim 1, wherein the overmolded body includes an outer surface, the pair holders being received in the outer shell cavity such that the outer surface of the overmolded body engages the outer shell to position the contacts within the cavity.

12. A cable connector comprising:

a cable having wires arranged in wire pairs;

contacts arranged in contact pairs, each contact including a supporting base between a mating end and a terminating end, the terminating end having a crimp barrel crimped to the corresponding wire; and pair holders holding the corresponding contact pairs, each pair holder having an overmolded body molded around the supporting bases of both contacts of the corresponding contact pair, the overmolded body being manufactured from a dielectric material, the pair holder fixing relative positions of the contacts within the corresponding contact pair, the terminating ends extending rearward from the overmolded body for termination to the wires, the mating ends extending forward of the overmolded body for mating with mating contacts of a mating connector, each overmolded body including a locating surface configured to engage a retainer for locating each of the pair holders relative to each other within the retainer.

13. The cable connector of claim 12, wherein the overmolded body includes an outer surface configured to engage an outer shell of the cable connector, the outer surface positioned relative to the contacts to locate the contacts relative to the outer shell.

14. The cable connector of claim 12, wherein the overmolded body includes an outer surface configured to engage a pair shield of the cable connector, the outer surface positioned relative to the contacts to locate the contacts relative to shield elements of the pair shield.

15. The cable connector of claim 12, wherein the crimp barrels of both contacts of the contact pair are simultaneously crimped to the wires of the corresponding wire pair.

16. The cable connector of claim 12, wherein the supporting bases of the contacts include generally flat pads, the overmolded body holding the supporting bases generally co-planar.

17. The cable connector of claim 12, wherein the contacts are stamped and formed contacts having generally flat supporting bases, generally cylindrical mating ends extending forward from the supporting bases, and the formed crimp barrels extending rearward from the supporting bases.

18. A method of manufacturing a cable connector comprising:

overmolding pair holders around supporting bases of contact pairs of contacts such that mating ends of the contacts extend forward of the pair holders and terminating ends of the contacts extend rearward of the pair holders, the terminating ends having crimp barrels, each pair holder being overmolded around both contacts of the corresponding contact pair to fix relative positions of the contacts of the corresponding contact pairs, each overmolded pair holder and contact pair defining a contact assembly;

simultaneously crimping the crimp barrels of both contacts of the corresponding contact assembly to wires of corresponding wire pairs to form a pair assembly;

loading a pair shield into a retainer between the wire pairs, the pair shield providing electrical shielding between the pair assemblies;

loading each pair assembly into the retainer such that the pair holders engage the retainer to position each of the contact assemblies relative to each other; and loading the retainer, pair shield, and pair assemblies into a cavity of an outer shell, the outer shell providing electrical shielding around the pair assemblies.

19. The method of claim 18, wherein each pair holder simultaneously loads the corresponding contacts into the retainer as a unit.

20. The method of claim 18, wherein further comprising coupling the pair holders to the retainer and to the outer shell, such that each pair holder positions the mating ends of both contacts of the corresponding contact assembly relative to the retainer and the outer shell for mating with mating contacts of a mating connector.

* * * * *